US006976679B2

(12) United States Patent
Goss et al.

(10) Patent No.: US 6,976,679 B2
(45) Date of Patent: Dec. 20, 2005

(54) INTER-FLUID SEAL ASSEMBLY AND METHOD THEREFOR

(75) Inventors: James D. Goss, Burbank, CA (US); Jozsef L. Moharos, Northridge, CA (US); Dean J. Nunez, Sherman Oaks, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/703,772

(22) Filed: Nov. 7, 2003

(65) Prior Publication Data

US 2005/0098957 A1 May 12, 2005

(51) Int. Cl.[7] ..... F16J 15/40; F16J 15/44

(52) U.S. Cl. ..... 277/347; 277/355; 277/412; 277/431; 415/112; 415/113; 415/168.2; 415/230

(58) Field of Search ..... 277/355, 347, 277/412, 431, 432; 415/111–113, 168.2, 415/174.2, 174.5, 230, 231

(56) References Cited

U.S. PATENT DOCUMENTS 3,392,910 A * 7/1968 Tanzberger ..... 415/111
4,078,809 A 3/1978 Garrick et al.
4,156,342 A * 5/1979 Korta et al. ..... 60/39.08
4,193,603 A 3/1980 Sood
4,368,895 A * 1/1983 Okamoto et al. ..... 277/347
4,500,093 A * 2/1985 Kapich ..... 277/347
4,756,536 A * 7/1988 Belcher ..... 277/355
4,924,817 A * 5/1990 Seelen ..... 122/379
5,211,535 A * 5/1993 Martin et al. ..... 415/170.1
5,454,689 A * 10/1995 Falavigna ..... 415/112
5,597,167 A 1/1997 Snyder et al.
5,632,492 A * 5/1997 Lehmann et al. ..... 277/409
6,000,701 A * 12/1999 Burgess ..... 277/412
6,131,910 A * 10/2000 Bagepalli et al. ..... 277/355
6,244,599 B1 6/2001 Braun et al.
6,330,790 B1 * 12/2001 Arora et al. ..... 60/39.08
6,398,484 B1 * 6/2002 Orikasa et al. ..... 415/112
6,402,157 B1 6/2002 Zhou et al.
6,416,057 B1 7/2002 Adams et al.

* cited by examiner

*Primary Examiner*—Alison K. Pickard
(74) *Attorney, Agent, or Firm*—Alston & Bird LLP

(57) ABSTRACT

An inter-fluid brush seal assembly and associated method are provided. The seal assembly defines a gas passage for supplying gas to interfaces with a rotatable member. At least one of the interfaces is defined by a brush seal, and the flow of the gas through the interfaces can prevent the flow of fluid through the assembly, thereby sealing the assembly and preventing the fluid from passing therethrough. The gas and the fluid can be drained from the assembly through one or more drains.

27 Claims, 8 Drawing Sheets

192
190
192
190
192
190

INTER-FLUID SEAL ASSEMBLY AND METHOD THEREFOR

FIELD OF THE INVENTION

This invention relates to seal assemblies and, in particular, to an inter-fluid seal assembly for restricting the flow of one or more fluids through an interface.

BACKGROUND OF THE INVENTION

Various applications require the formation of a seal between adjacent components such that the seal prevents the flow of fluids between the components. In some cases, the seal is disposed between first and second fluids, and the seal is configured to prevent the flow of the fluids therethrough such that the fluids do not mix. For example, FIG. 1 illustrates a conventional turbopump 10 for a rocket engine, such as the high pressure oxidizer turbopump for the space shuttle main engine, an engine built by the Rocketdyne division of The Boeing Company. The turbopump 10 includes a pump portion 12 and a turbine portion 16. A shaft 20, sometimes referred to as a "rotor," extends between the two portions 12, 16 to mechanically couple a pump 14 in the pump portion 12 to a turbine 18 in the turbine portion 16, so that the pump 14 can be rotatably actuated by the turbine 18.

During operation, the pump 14 is used to pump cold fluids such as liquid oxygen. The turbine portion 16, however, typically operates at high temperatures, e.g., 1000° F. or greater. In some cases, additional cooling fluids are provided for cooling the turbine 18 or other components in the turbine portion 16. For example, the shaft 20 can be supported by bearings 19 positioned proximate to the turbine 18, and a coolant fluid can be provided for cooling the bearings 19. It is often desirable for the coolant fluid to be a different fluid than the fluid being pumped by the pump 14 and for the coolant fluid and the pumped fluid to remain separate in the turbopump 10. For example, if the pump 14 is used to pump liquid oxygen, and liquid hydrogen is provided to the bearings 19 as the coolant fluid, it can be necessary to prevent the mixing of the oxygen and hydrogen to prevent an undesired reaction of the two fluids. Further, although some flow of the hydrogen into the turbine 18 can be acceptable, flow of oxygen to the turbine 18 can be undesirable.

Therefore, an interpropellant seal, also referred to as an inter-fluid seal, can be provided for preventing the cryogenic oxygen from flowing from the pump portion 12 to the turbine portion 16. The interpropellant seal can include one or more labyrinth seals 22, 24, 26 disposed in a housing 28, as illustrated in FIG. 2. A gas inlet 23 can be disposed between the first and second labyrinth seals 22, 24 and configured to receive an inert gas for maintaining separation between the oxygen and hydrogen. In particular, the inert gas can flow radially inward through the inlet 23, then axially in opposite directions so that some of the gas flows toward the first labyrinth seal 22 and some flows toward the second and third seals 24, 26. The gas flowing toward the first labyrinth seal 22 mixes with the oxygen passing through the seal 22, and the oxygen and gas exit through a drain 30. Similarly, the gas flowing toward the second and third labyrinth seals 24, 26 mixes with the hydrogen passing through those seals 24, 26, and the hydrogen and/or gas exit through two drains 32, 34. Each of the drains 30, 32, 34 can include an annular space that extends circumferentially around the shaft 20, and each drain 30, 32, 34 can include a bore (not shown) that extends outward from the annular space through the housing 28 to provide a passage between the annular space and an outer surface of the housing 28.

Each labyrinth seal 22, 24, 26 typically defines a plurality of circumferentially-extending grooves that are machined into the outer surface of the shaft 20, into an outer surface of a sleeve or other component provided on the shaft 20, or into an adjacent surface on the inner diameter of the housing 28. The grooves and the clearance between the shaft 20 and housing 28 are typically designed to very specific dimensions, e.g., with tolerances of 0.001 inches or less. Variations in the dimensions of the grooves can result in an imbalance in pressure of the oxygen and hydrogen flowing through the seals 22, 24, 26 and therefore an imbalance in the flow of the inert gas. Sufficient flow of the inert gas must be maintained in both directions to prevent the oxygen and the hydrogen from flowing through the interpropellant seal. Thus, the interpropellant seal must be designed for the particular flow characteristics of the application, including the pressures and temperatures of the fluids, the dimensions of the seals 22, 24, 26, the desired flow rate of the fluids and gas, and the like. In order to achieve a desired separation of the fluids, the labyrinth seals 22, 24, 26 may be required to be long, thereby requiring space in the housing 28 along the shaft 20. Further, a significant amount of inert gas may be delivered through the interpropellant seal during operation. For a turbopump that is used on a vehicle, the added weight of the inert gas that must be carried for operation of the seal can be significant.

Thus, there exists a need for an improved sealing assembly for turbopumps and other applications requiring a fluid seal. The sealing assembly should be capable of preventing the flow of one or more fluids therethrough and for preventing the mixing of those fluids. Preferably, the seal should be relatively small and should not require an excessive amount of interpropellant gas during operation.

SUMMARY OF THE INVENTION

The present invention provides an inter-fluid brush seal assembly and an associated method for preventing the flow of fluid adjacent a rotatable member. A gas can be supplied through a gas passage and through interfaces, one or more of which can be defined by a brush seal. The flow of the gas can be used to prevent flow of the fluid along the rotatable member and through the assembly, thereby sealing the assembly. Advantageously, the brush seals can be relatively small relative to the axial length of a labyrinth seal. Further, in some embodiments, the gas required for forming a seal at the interface can be less than the gas that would be required to form a seal using a labyrinth seal.

According to one embodiment of the present invention, the seal assembly includes a dispersion ring defining a bore extending therethrough for receiving the rotatable member. The dispersion ring also defines a gas passage that extends at least partially circumferentially around the bore of the dispersion ring. At least one brush seal is disposed toward a first side of the gas passage. The brush seal has a circumferential member that is structured to extend circumferentially around the rotatable member. A plurality of elongate members are connected to the circumferential member and extend generally radially inward to define a flow restricting interface with the rotatable member. A second seal, also structured to extend circumferentially around the rotatable member, is positioned opposite the gas passage from the brush seal and directed toward the second side of the gas passage. The second seal, which can be defined by one or more brush seals similar to those of the first interface, defines a second interface with the rotatable member. The assembly also includes a housing that defines a bore for receiving the dispersion ring. The housing has an inlet and first and second drains fluidly connected to the bore. The inlet is disposed axially between the first and second drains and fluidly connected to the gas passage. The first and second drains are fluidly connected to the first and second interfaces, respectively, so that the first and second drains are configured to receive the gas from the inlet via the first and second interfaces. Each of the inlet and drains can include an annular space that extends circumferentially around the bore of the housing so that fluid can be communicated between the annular spaces and the respective inlet or drain. Thus, the dispersion ring is configured to receive a gas from the inlet of the housing, communicate the gas through the gas passage, and deliver the gas to the first and second interfaces so that the gas substantially prevents the flow of fluid through the seal assembly. The pressurized gas can be supplied by a gas source to the gas passage via the gas inlet. Also, a control valve fluidly disposed between the gas source and the gas passage can be configured to control the flow of gas to the gas passage.

According to one aspect of the invention, the dispersion ring has first and second walls that extend radially inward toward the rotatable member and define the gas passage therebetween. At least one aperture extends radially through the ring to fluidly connect the gas passage to the inlet in the housing. The dispersion ring can also be configured to receive the brush seal therein. Further, the brush seal and the dispersion ring can be engaged to prevent relative rotation therebetween. A retaining ring with a bore corresponding to the rotatable member can be received in the bore of the housing so that the retaining ring partially restricts the flow of the fluid along the rotatable member.

A seal member, such as a labyrinth seal or one or more brush seals, can also be provided in the bore of the housing axially opposite a respective one of the drains from the gas passage, so that the seal member and a respective one of the interfaces defines an annular space therebetween. The annular space is fluidly connected to the respective drain, and the seal member corresponds to the rotatable member so that the seal member partially restricts the flow of the fluid along the rotatable member and toward the drain. The dispersion ring can be configured to receive the seal member, and a spacer disposed between the seal member and the respective interface can maintain the annular space therebetween. Each of the spacer and the dispersion ring can define apertures that extend radially therethrough so that the annular space is fluidly connected to the respective drain. Further, an outer drain can be fluidly connected to a point along the rotatable member axially opposite at least a portion of the seal member from the gas passage.

The present invention also provides a method for preventing the flow of at least one fluid through a seal assembly. The method includes supplying a gas to a gas passage defined by a dispersion ring extending circumferentially around a rotatable member. The gas is circulated in first and second axial directions through first and second interfaces, so that flow of the fluid through the interfaces is prevented. For example, the gas can be supplied through an inlet defined by a housing so that the gas flows through the inlet and into the gas passage of the dispersion ring. The gas can be supplied circumferentially around the dispersion ring through an annular space defined by the housing. Similarly, the fluid and the gas can be drained through one or more annular spaces extending circumferentially around the bore of the housing. Thus, the method can prevent the flow of first and second fluids through the interfaces. The gas can be provided from a pressurized gas source, and a valve can be adjusted to control the flow of the gas from the gas source to the gas passage.

According to one aspect of the invention, at least one seal member can be provided axially opposite a respective one of the drains from the gas passage so that the seal member and the respective interface defines an annular space therebetween in fluid communication with the respective drain. Further, one of the fluids can be drained through an outer drain fluidly connected to a point along the rotatable member axially opposite at least a portion of the seal member from the gas passage.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate preferred and exemplary embodiments, but which are not necessarily drawn to scale, wherein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 3:
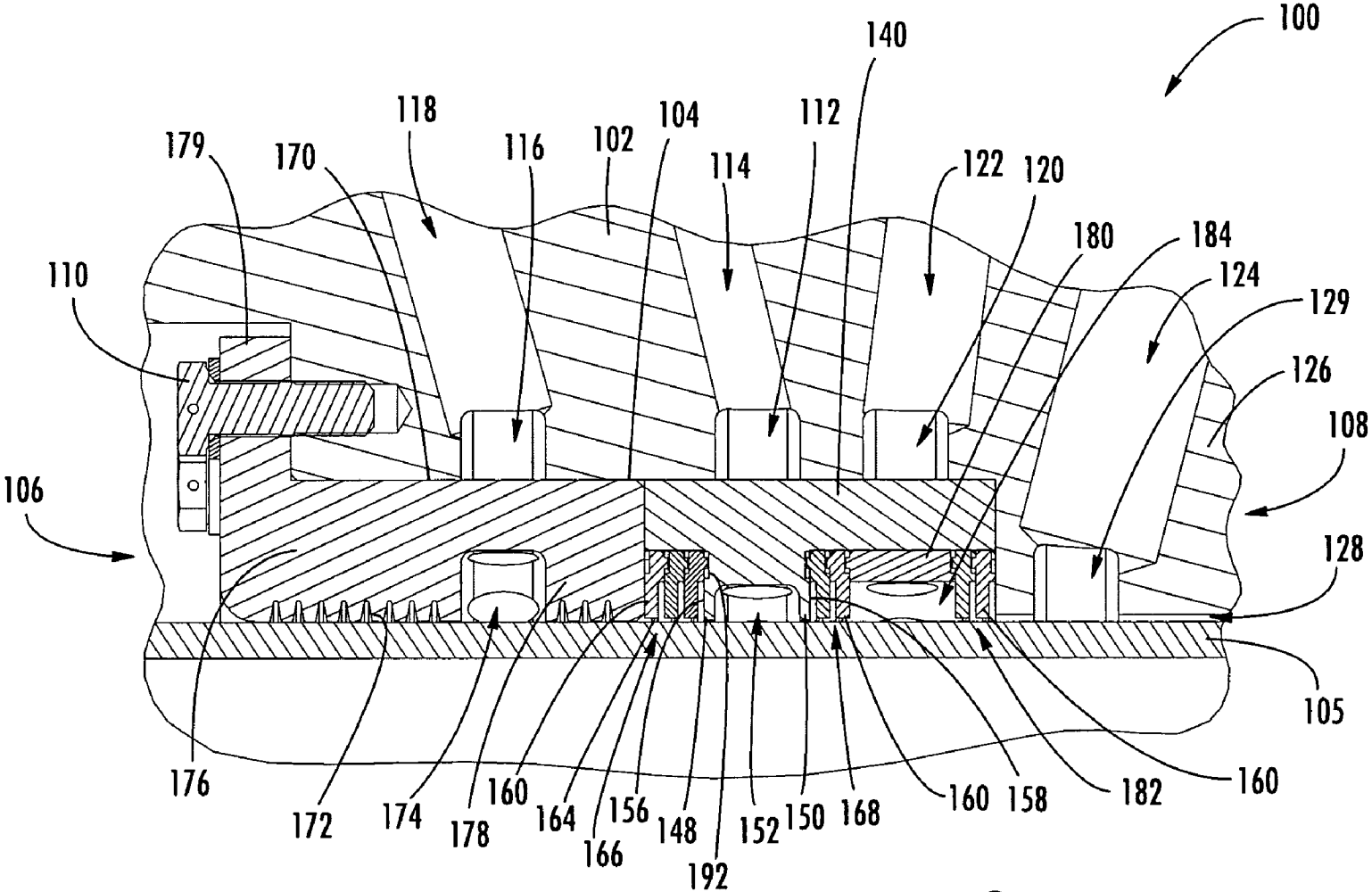
FIG. 3 is a section view illustrating a seal assembly according to one embodiment of the present invention.

Referring to the drawings and, in particular, to FIG. 3, there is illustrated an inter-fluid seal assembly 100 according to one embodiment of the present invention. The seal assembly 100 is used for forming a seal between first and second fluids. For example, the seal assembly 100 can be used to form a seal between liquid oxygen that is pumped by a turbopump for a rocket engine, such as the turbopump 10 illustrated in FIG. 1, and liquid hydrogen provided for cooling a bearing that supports a shaft in a turbopump. Alternatively, the seal assembly 100 can be used in devices for various other applications, such as for forming seals between shafts, housings, or other components that relatively rotate or otherwise move in pumps, engines, turbines, and the like. The seal assembly 100 can be used to seal fluids, such as the cryogenic fluids that are used to chill the turbopump 10 (FIG. 1) and that are pumped thereby. The seal assembly 100 can also be used to restrict the flow of other liquids, lubricants, gases, or other fluids. Further, it is appreciated that the seal assembly 100 is configurable according to the shape, configuration, and design requirements of a device that requires sealing. Additional sealing apparatuses and methods, including apparatuses and methods for effecting a controllable seal, are provided in U.S. application Ser. No. 10/703,776, titled "Gas-Buffered Seal Assembly and Method Therefor," filed concurrently herewith, the entire content of which is herein incorporated by reference.

Figure 1:
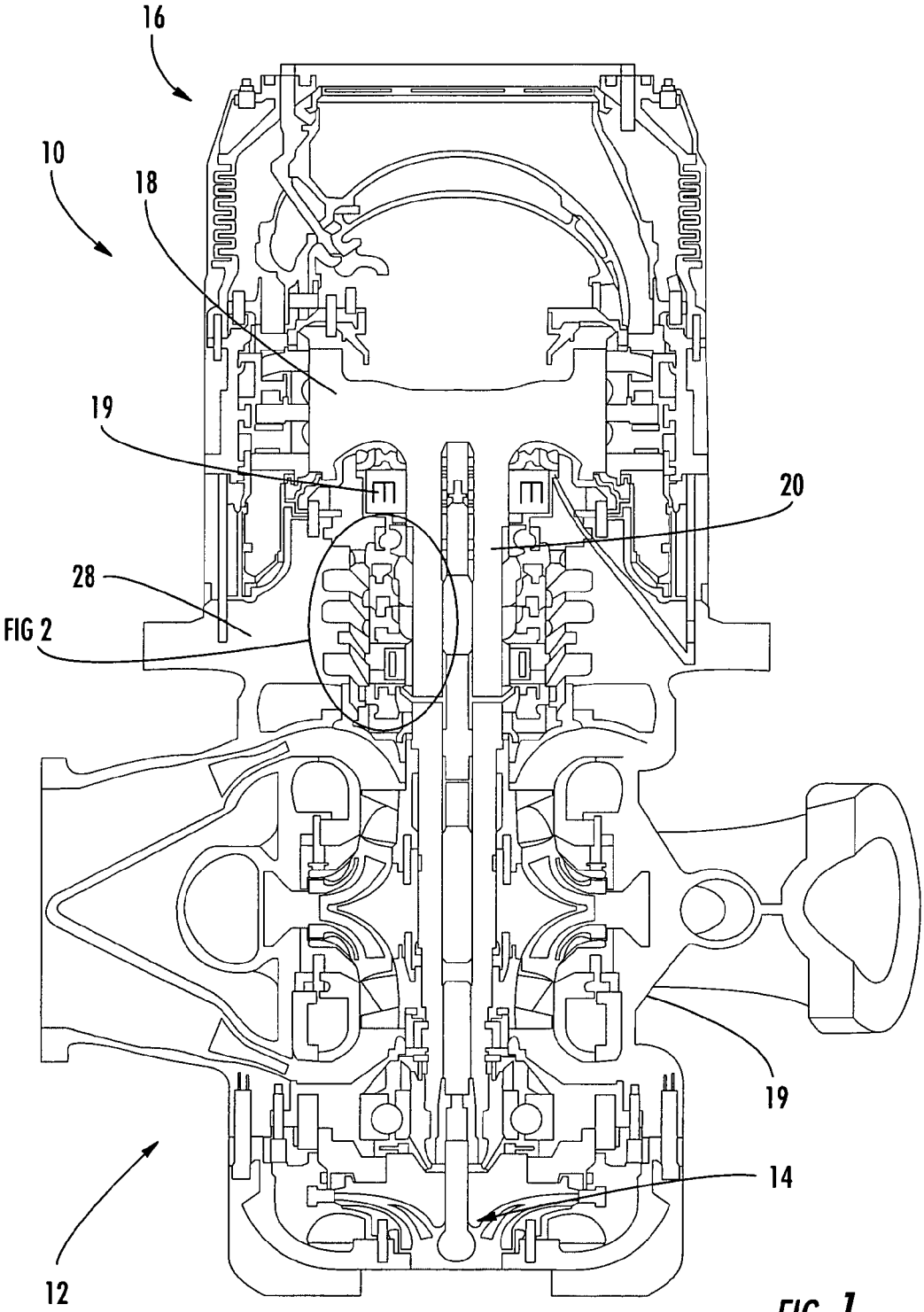
FIG. 1 (PRIOR ART)
FIG. 1 is section view illustrating a conventional turbopump for a rocket engine.
Figure 2:
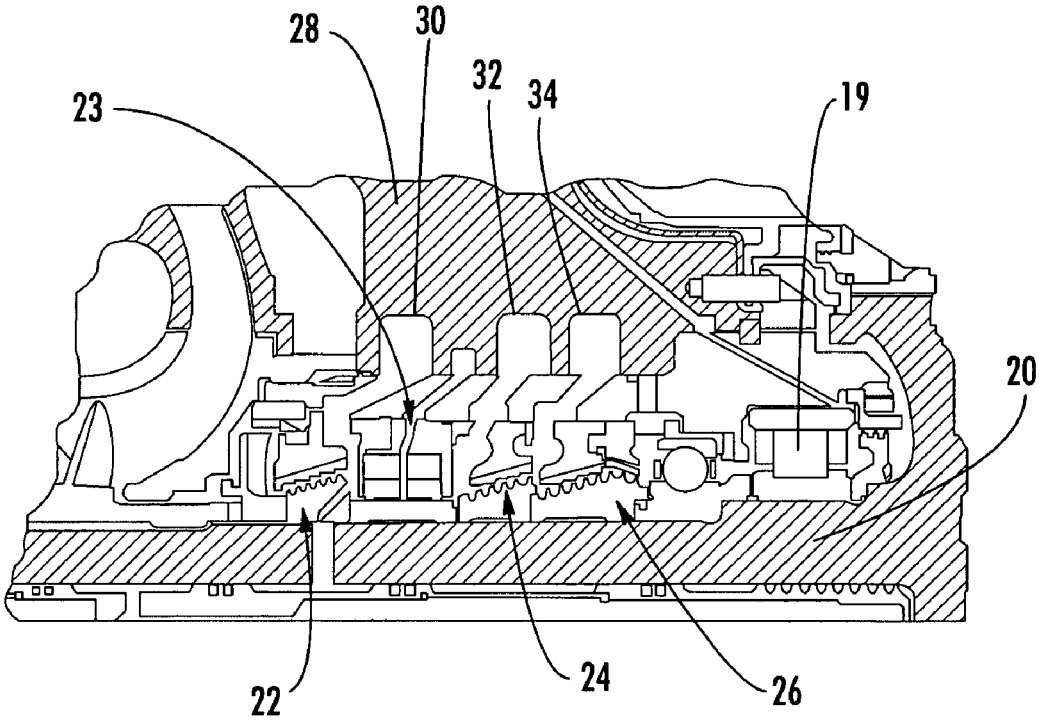
FIG. 2 (PRIOR ART)
FIG. 2 is a partial section view illustrating an interpropellant seal of the turbopump of FIG. 1.

The seal assembly 100 includes a seal housing 102 that defines a bore 104 therethrough for receiving a rotatable member 105, such as the shaft 20 of the turbopump 10 that extends between the pump 14 and the turbine 18 of FIG. 1. The seal housing 102 can be received by, and fixedly positioned within, an outer housing (not shown) of a turbopump or other device. The rotatable member 105, which extends in an axial direction through the seal assembly 100, can be rotated or otherwise moved relative to the seal assembly 100. The first and second fluids, which can be similar or dissimilar fluids, are provided on first and second sides 106, 108 of the seal assembly 100, respectively. The seal assembly 100 generally restricts the flow of the fluids therebetween. Further, the seal assembly 100 can prevent the mixing of the fluids, both inside and outside the seal assembly 100.

Figure 4:
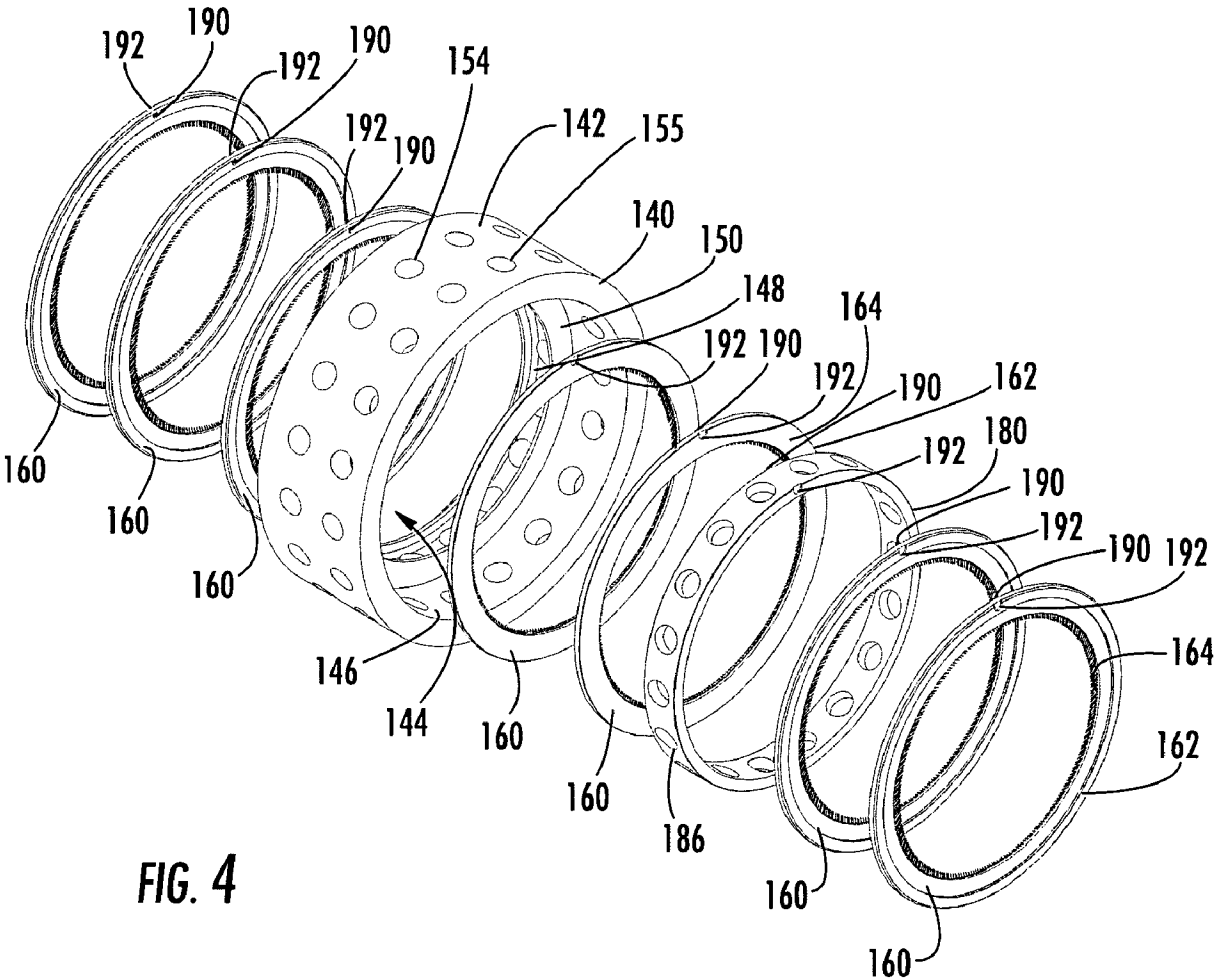
FIG. 4 is an exploded view illustrating some of the components of the seal assembly of FIG. 3.

The seal assembly 100 includes one or more members disposed in the bore 104 of the housing 102. For example, the embodiment illustrated in FIG. 3 includes a dispersion ring 140 and a retaining ring 170 disposed in the housing 102. The dispersion ring 140 is structured to receive a number of brush seals 160, as illustrated in FIG. 4. The retaining ring 170 is configured proximate to the dispersion ring 140 and can be connected to the housing 102, e.g., by bolts 110 that extend through a flange 179 of the retaining ring 170, so that the dispersion ring 140 and the retaining ring 170 are secured to the housing 102. In other embodiments, the seal assembly 100 can be otherwise configured, e.g., to include only one member in the bore 104 of the housing 102 or to include additional members therein. Additionally, the members can be otherwise secured in the housing, e.g., by an end plate or a threaded engagement between the members and the housing.

As illustrated in FIGS. 3 and 4, the dispersion ring 140 defines an outer surface 142 and a bore 144 defined by an inner surface 146 for receiving the rotatable member 105. The outer surface 142 is directed toward the housing 102, and the inner surface 146 is directed toward the rotatable member 105. First and second walls 148, 150 extend radially inward from the inner surface 146 toward the rotatable member 105 and define a gas passage 152 therebetween that extends circumferentially around the rotatable member 105. The dispersion ring 140 also defines first apertures 154 that extend radially between the outer and inner surfaces 142, 146, thereby fluidly connecting the gas passage 152 to the bore 104 of the housing 102. More particularly, the dispersion ring 140 is disposed proximate to an annular space 112 in the seal housing 102 that extends circumferentially around the dispersion ring 140. The annular space 112 is fluidly connected to a gas inlet 114, i.e., a passage extending through the housing 102, so that the apertures 154 connect the gas passage 152 to the gas inlet 114. A connector (not shown) can be provided on the outside of the housing 102 so that the gas inlet 114 can be fluidly connected to a gas source. Alternatively, if the housing 102 is disposed in an outer housing, the outer housing can define a passage extending outward from the gas inlet 114, and the connector can be provided on the outer housing. Thus, the gas inlet 114 is configured to receive a gas and circulate the gas to the gas passage 152. Although the dispersion ring 140 is illustrated as a unitary member that defines the gas passage 152, the dispersion ring 140 can alternatively include multiple members that are configured to define the passage 152.

In other embodiments of the present invention, multiple gas inlets can be provided through the housing 102, and/or the annular space 112 can extend only partially around the dispersion ring 140. Alternatively, the annular space 112 can be omitted and the gas inlet(s) 114 can extend to define an aperture proximate to the dispersion ring 140, i.e., so that the gas inlets fluidly communicate directly with the apertures 154 and the gas passage 152 of the dispersion ring 140. The gas source provided for supplying the gas to the gas inlet 114 can be a storage vessel filled with a pressurized or liquefied gas or a device for pressurizing gas such as a compressor. The gas can be an inert gas such as helium, nitrogen, argon, and the like. Alternatively, the gas can be air, other mixtures of gases, or other gases.

The first apertures 154, which are uniformly located around the circumference of the dispersion ring 140 as shown in the illustrated embodiment, can alternatively be placed at nonuniform positions. For example, the apertures 154 can be located increasingly closer at circumferential positions further from the gas inlet 114 so that the gas is provided through the gas passage 152 to have a substantially uniform pressure therein. Similarly, each of the apertures 154 can have a similar diameter, or the diameters can vary throughout the dispersion ring 140 according to the location of the apertures 154. For example, relatively smaller apertures 154 can be disposed near the inlet 114 of the seal housing 102 than those apertures 154 further from the inlet 114. As a result, the gas can be provided at a relatively uniform pressure around the circumference of the brush seals 160. It is appreciated that the wall members 148, 150 can be structured in various other configurations to achieve the desired distribution of gas, and in some cases, such as where the annular space 112 is sufficiently large, a uniform placement of similar apertures 154 can result in a relatively uniform pressure of the gas throughout.

The dispersion ring 140 is structured to receive the brush seals 160, which can be disposed on first and second sides 156, 158 of the gas passage 152 to define first and second interfaces 166, 168 on the first and second sides 156, 158, respectively. In the illustrated embodiment, three brush seals 160 are provided on the first side 156, and two brush seals 160 are provided on the second side 158 of the gas passage 152. However, in other embodiments of the present invention, the assembly 100 can alternatively include any number of brush seals 160 disposed on one or both sides 156, 158 of the dispersion ring 140. Each of the brush seals 160 includes a circumferential member 162 that extends around the rotatable member 105, and a plurality of elongate members 164 that extend radially inward from the circumferential member 162 toward the rotatable member 105. The elongate members 164 can be wires, as are typically used in a wire brush seal. Alternatively, the elongate member 164 can be flexible strips or otherwise shaped members. The members 164 can be formed of stainless steel, other metals, or other materials, depending on the operational characteristics of the seal 100, including the temperature and pressure of the fluid, the operational speed of the rotatable member 105, and the like.

Typically, the elongate members 164 are disposed at an angle relative to the radial direction of the brush seals 160 so that the elongate members 164, which are longer than the distance between the circumferential member 162 and the rotatable member 105, are biased against the rotatable member 105 to form interfaces 166, 168 with the rotatable member 105. Preferably, the elongate members 164 are angled circumferentially in the same direction as the rotation of the rotatable member 105. Each of the interfaces 166, 168 provides a restriction to flow of the fluid, though some fluid can flow through the interfaces 166, 168, i.e., between the elongate members 164 or between the elongate members 164 and the rotatable member 105. The restrictive effect of the brush seals 160 can be increased by providing a pressurized gas to the brush seals 160 and/or a flow of the gas through the brush seals 160, as described further below. Further, the brush seals 160 can provide a resistance to flow therethrough that is more consistent than the resistance typically provided by a conventional labyrinth seal. In particular, while the resistance of a labyrinth seal can be affected significantly by the clearance between the labyrinth seal and a shaft or other rotatable member extending therethrough, the brush seals 160 can provide a relatively consistent resistance due to the flexing of the elongate members 164 to correspond to small variations in diameter of the rotatable member 105. Thus, if the dimensional properties of the rotatable member 105 and/or the seals 160 change, e.g., due to temperature variations that result from a change in a flow of gas therethrough, the seals 160 can still provide a relatively consistent flow resistance. A consistent resistance to flow can facilitate the sealing effect of the seal assembly 100 between pressurized fluids on the opposite sides 106, 108 of the assembly 100.

Figure 5:
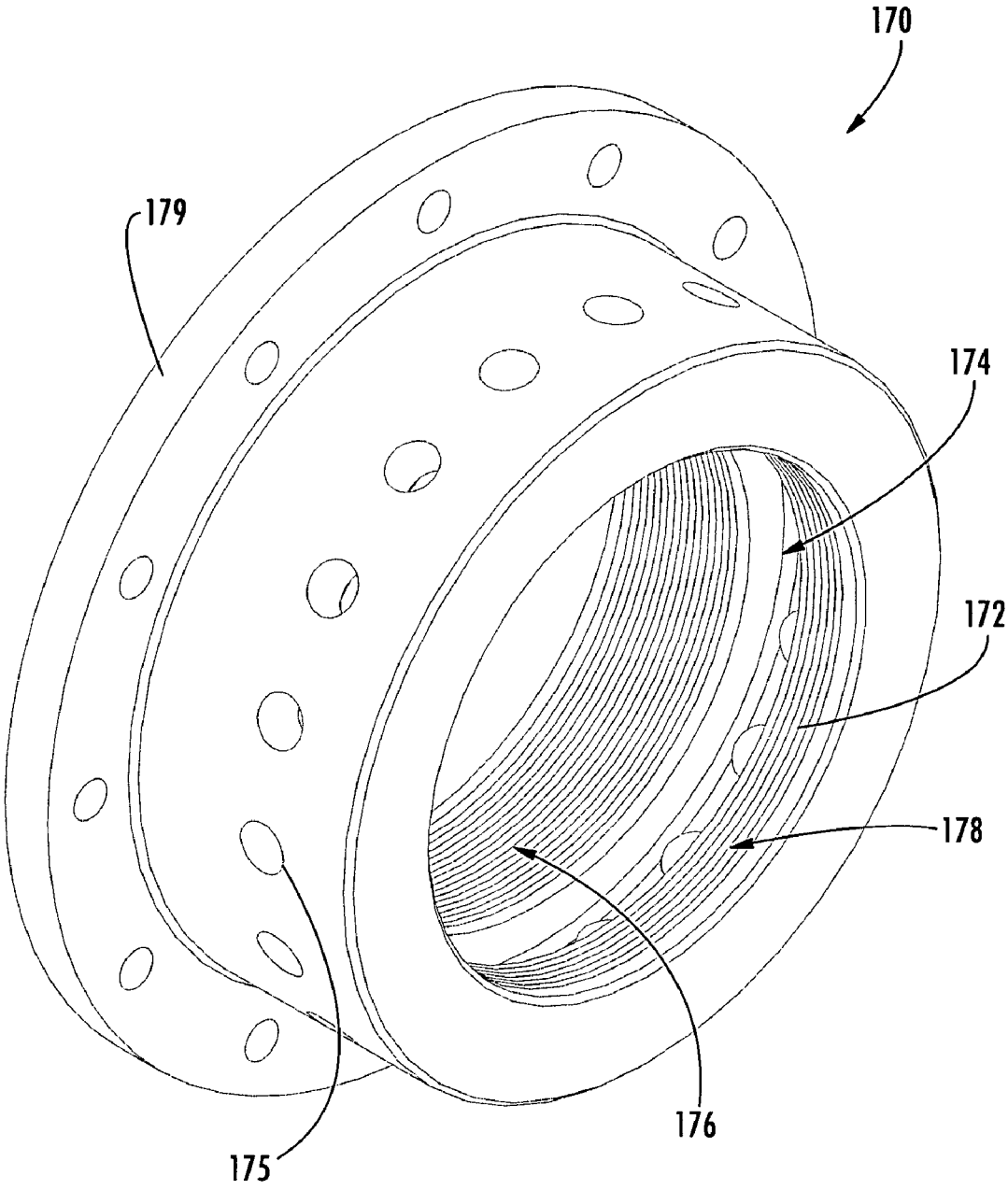
FIG. 5 is a perspective view illustrating the retaining ring of the seal assembly of FIG. 3.

The retaining ring 170 forms a seal with the rotatable member 105 that restricts the flow of the first fluid from the first side 106 of the seal assembly 100 axially along the rotatable member 105 in a direction toward the second side 108. For example, as shown in FIG. 5, the retaining ring 170 can define a plurality of thread-like grooves 172 that form first and second seal portions 176, 178 of a labyrinth seal with the rotatable member 105. Further, the retaining ring 170 can define an annular space 174 that extends circumferentially around the rotatable member 105 and apertures 175 that fluidly connect the annular space 174 to an annular space 116 defined by the housing 102. A drain 118, defined by a passage extending through the housing 102, is fluidly connected to the annular space 116 and thereby provides an exit through which the first fluid can be exhausted from the assembly 100. Thus, fluid that passes through the first seal portion 176 of the retaining ring 170 is received by the annular space 116, and flows therefrom through the drain 118.

Opposite the gas passage 152 from the retaining ring 170, the dispersion ring 140 receives a spacer 180 and two additional brush seals 160 for forming an interface or seal 182 axially outward from the second interface 168 at the second side 108 of the gas passage 152. The brush seals 160 for the seal 182 also correspond to the diameter of the rotatable member 105 so that the seal 182 partially restricts the flow of the second fluid along the rotatable member 105 toward the gas passage 152. The spacer 180 maintains an annular space 184 between the seal 182 and the second interface 168. Further, the spacer 180 can define apertures 186 that fluidly connect the space 184 to an annular space 120 defined by the housing 102 around the dispersion ring 140 via second apertures 155 extending through the dispersion ring 140. A drain 122, defined by a passage extending through the housing 102, is fluidly connected to the annular space 120 and thereby provides a drain for receiving the second fluid from the second side 108 of the seal assembly 100. Fluid that passes through the brush seals 160 of the seal 182 is received by the annular space 120, and flows therefrom through the drain 122.

Thus, seal members, such as the retaining ring 170 and the brush seals 160 of the seal 182, can be provided on either or both sides of the gas passage 152 and can define annular spaces 116, 120 through which the first and second fluids can be received. The fluids are then drained from the assembly 100 through the drains 118, 122. In addition, an outer drain 124 can be provided axially opposite the brush seals 160 of the seal 182 from the second interface 168. The outer drain 124 extends to the rotatable member 105 at a point along the member 105 axially opposite the seal 182 from the gas passage 152. The outer drain 124 is fluidly connected to the rotatable member 105 such that fluid flowing outside the seal assembly 100 and toward the second side 108 of the seal assembly 100 can be received by the outer drain 124 and drained therefrom. Further, a portion 126 of the housing 102 at the second side 108 of the seal assembly 100 can correspond to the diameter of the rotatable member 105 to define a seal 128 that restricts the flow of the second fluid into second side 108 of the assembly 100. The portion 126 can define an annular space 129 through which the second fluid flows between the second side 108 and the outer drain 124. Although only one outer drain is illustrated, an outer drain can similarly be configured opposite the retaining ring 170 from the gas passage 152 to receive the first fluid before the first fluid enters the seal assembly 100 at the first side 106.

Each of the brush seals 160, dispersion ring 140, retaining ring 170, and housing 102 can also define one or more features for engaging the adjacent components. For example, each of the brush seals 160, dispersion ring 140, and spacer can define a tab 190 extending axially and a pocket 192 corresponding in size and location to the tabs 190 of the adjacent components. Thus, the components engage one another, thereby preventing relative rotation of the components that might otherwise result from the rotation of the rotatable member 105 and/or rotational flow of the fluid. Further, it is appreciated that although the retaining ring 170, dispersion ring 140, brush seals 160, and spacer 180 are shown as separate components, any of these components can be formed integrally with each other.

Figure 6:
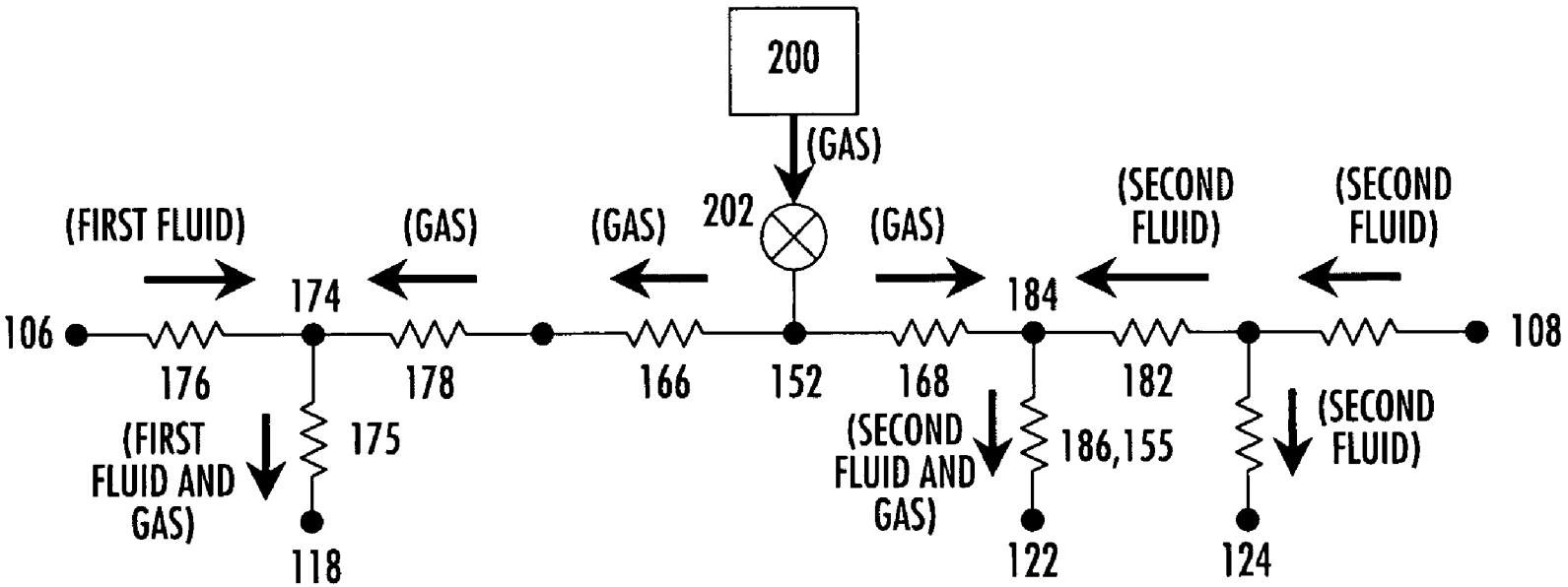
FIG. 6 is a schematic view illustrating the operation of the gas seal of FIG. 3 according to one mode of operation of the present invention.

Referring to FIG. 6, there is shown a schematic view illustrating the flow of the fluids and gas through the seal assembly 100. Each of the elements of the seal assembly 100 is indicated to have a resistive effect on the flow of the gas and the fluid. In operation, the gas, which is supplied by a gas source 200, enters the seal assembly 100 through a control valve 202, flows therefrom to the gas inlet 114 of the housing 102, and then flows to the annular space 112. The gas flows circumferentially in the annular space 112 around the dispersion ring 140, and into the gas passage 152 through the apertures 154. From the gas passage 152, the gas flows axially along the rotatable member 105, i.e., between the rotatable member and the walls 148, 150, to the interfaces 166, 168 defined by the brush seals 160. Advantageously, the flow of the gas through the interfaces 166, 168 can substantially entirely prevent the flow of the fluids through the interfaces 166, 168. For example, gas flowing from the gas passage 152 in a first axial direction passes through the first interface 166 and continues to flow axially through the second portion 178 of the retaining ring 170 to the annular space 174. The first fluid enters the assembly 100 in an opposite direction from the first side, flows between the rotatable member 105 and the first portion 176 of the retaining ring 170, and into the annular space 174, from which the first fluid and the gas are received by the drain 118. Gas flowing from the gas passage 152 in a second axial direction passes through the second interface 168 to the annular space 184. The second fluid flows into the assembly 100 through the space 128, from which some of the fluid is received by drain 124. The second fluid that does not exit through the drain 124 flows through the seal 182 and into the annular space 184, from which the second fluid exits the assembly 100 through the drain 122 with the gas. The gas and fluids can be drained from the assembly 100 through the drains 118, 122, 124, e.g., to be vented to the environment or to be recirculated for reuse.

The gas flowing axially through the first brush seal 166 toward the first side 106 of the seal housing 102 opposes the flow of the first fluid from the first side 106 through the seal assembly 100. In particular, the flow of gas through the brush seals 160 of the first interface 166 can prevent the first fluid from flowing through the second portion 176 of the retaining ring 170 and the first interface 166. Similarly, the flow of gas through the second interface 168 can prevent the second fluid from flowing through the brush seals 160 of the second interface 168. Thus, the flow of the gas through the interfaces 166, 168 prevents the fluids from flowing through the seal assembly 100 and from mixing with one another in the seal assembly 100.

Further, the flow of the gas can be used to prevent the fluids from contacting the brush seals 160 or other components of the seal assembly 100. For example, in the embodiment of FIG. 3, the gas flowing through the first interface 166 continues to flow through the second seal portion 178 of the retaining ring 170 as described above, thereby preventing the first fluid from passing through the second seal portion 178 and preventing the first fluid from contacting the brush seals 160 of the first interface 166. It may be desirable to avoid such contact, for example, where the first fluid is liquid oxygen, the brush seals 160 are formed of steel, and the presence of oxygen at the interface 166 could promote combustion.

It will be appreciated that the pressure or flow rate of the gas that is required for preventing flow of the fluids through the assembly 100 can depend on the pressure of the first and second fluids at the sides 106, 108 of the assembly 100; the viscosity of the fluids; the size, number, and configuration of the brush seals 160 and other seals or other components of the seal assembly 100; the number, location, and dimensions of drains; the pressure in the various drains; and the like. In this regard, the control valve 202 can be disposed between the gas source 200 and the seal assembly 100 such that the control valve 202 can adjust the flow and/or pressure of the gas provided to the seal assembly 100 from the gas source 200. Similarly, the flow of the fluids and gas through the drains 118, 122, 124 can be regulated by valves or other devices, such as devices defining flow restricting orifices that are disposed in the drains 118, 122, 124.

The pressure and/or flow rate of the gas can be adjusted during operation to achieve the desired flow rate of the fluid. For example, the control valve 202 can be adjusted manually or automatically, e.g., by an electronic control device that responds to the desired flow rate of the fluid through the assembly 100 according to one or more operational aspects of the device in which the assembly 100 is installed. Thus, the valve 202 can be used to change the flow of gas provided to the brush seals 160 and, hence, prevent the flow of fluids through the assembly 100. Preferably, the flow of fluids through the seal assembly 100 can be prevented by providing a flow of gas that does not result in gas flowing from the first and second sides 106, 108 of the assembly 100 to mix with the first and second fluids outside the assembly 100. Further, excessive flow of the gas can be avoided to prevent plastic deformation of the elongate members 164 or otherwise significant parting or other deformation of the elongate members 164.

While the seal assembly illustrated in FIG. 3 generally includes one arrangement of brush and labyrinth seals on either side of the gas passage 152, it is appreciated that other configurations can be used in other embodiments of the present invention. In particular, it is noted that brush seals 160 can be provided on either or both sides 156, 158 of the gas passage 152, and labyrinth seals can be provided in addition or alternative on either side 156, 158 of the passage 152. Generally, the brush seals 160 can be axially shorter than labyrinth seals, and the volume of gas required for operating the brush seals 160 can be less than that required for operating a labyrinth seal. Therefore, in some embodiments, it may be desirable to use brush seals 160 on one or both sides 156, 158 of the gas passage 152 to reduce the amount of gas that is required for operating the seal assembly 100 or to reduce the length of the seal assembly 100.

Figure 7:
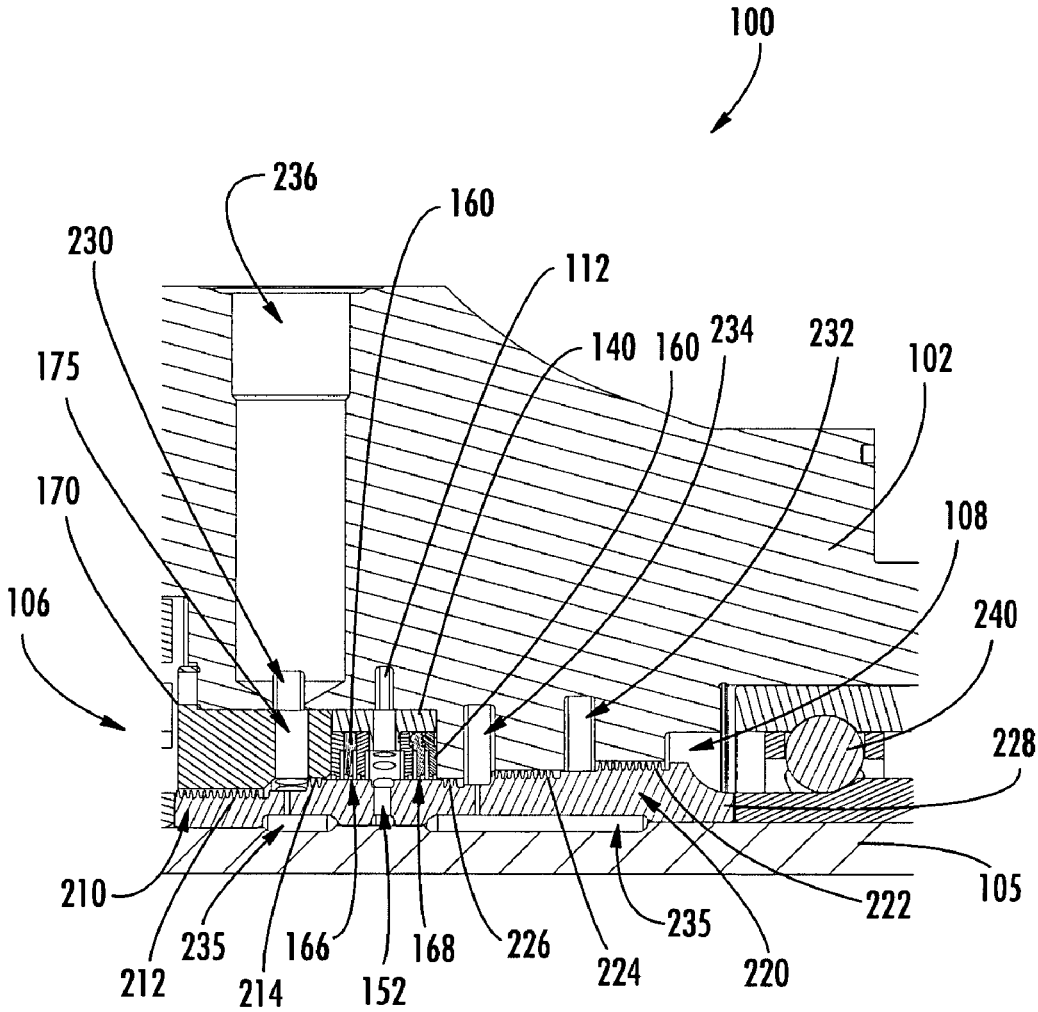
FIG. 7 is section view illustrating a seal assembly according to another embodiment of the present invention.
Figure 8:
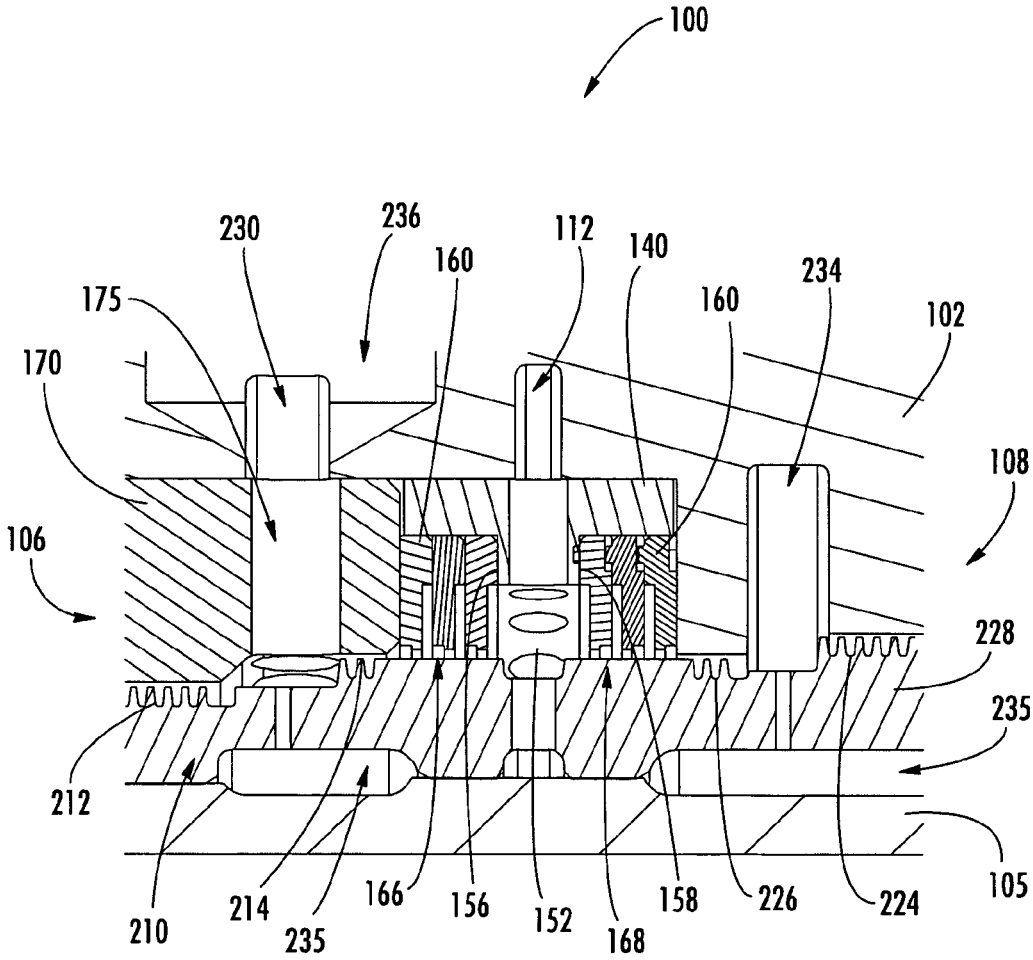
FIG. 8 is a partial section view illustrating the seal assembly of FIG. 8.

For example, the seal assembly 100 shown in FIGS. 7 and 8 includes a dispersion ring 140 structured to receive three brush seals 160 for forming the first and second interfaces 166, 168 on either side 156, 158 of the gas passage 152. Labyrinth seals 210, 220 are also provided on each side 156, 158, axially outward from the interfaces 166, 168. The first labyrinth seal 210 is defined between the rotatable member 105 and a retaining ring 170. The second labyrinth seal 220 is defined between the rotatable member 105 and the housing 102 of the seal assembly 100. In particular, the labyrinth seals 210, 220 are defined by grooves disposed in a sleeve 228 secured to the rotatable member 105, though the seals 210, 220 can alternatively be formed by forming grooves in the retaining ring 170 and the housing 102 or directly on the rotatable member 105. Annular spaces 230, 232, 234 are positioned at axial positions throughout the labyrinth seals 210, 220. Passages 235 can be provided between the sleeve 228 and the rotatable member 105, and the passages 235 can also be fluidly connected to annular spaces 230, 232, 234, such that any fluid that flows between the sleeve 228 and the rotatable member 105 is drained therefrom to the annular spaces 230, 232, 234. Drains are provided for receiving the gas and fluids from each of the annular spaces 230, 232, 234, although only one drain 236 is illustrated, the other drains being disposed at other circumferential positions not visible in the illustration. Similarly, a gas inlet provided for supplying the gas through the annular space 112 to the gas passage 152 is not shown, the gas inlet being disposed at a circumferential position not illustrated.

A first fluid entering the assembly 100 from the first side 106 passes through a first portion 212 of the first labyrinth seal 210, through the apertures 175 in the retaining ring 170, and into the annular space 230 from which the fluid is received by the drain 236. Similarly, a second fluid entering the assembly 100 from the second side 108, e.g., a coolant fluid flowing from a bearing 240, passes through a first portion 222 of the second labyrinth seal 220 and into the annular space 232 from which some of the fluid is received by another drain. The remaining second fluid continues through the second portion 224 of the labyrinth seal 220 and into the annular space 234, from which the second fluid is received by another drain. Gas flowing into the gas passage 152 flows axially in first and second directions. Gas flowing toward the first side 106 of the assembly 100 passes through the first interface 166 and through a second portion 214 of the first labyrinth seal 210 to the annular space 230, from which the gas is received by the drain 236 with the first fluid. Gas flowing toward the second side 108 of the assembly 100 passes through the second interface 168 and through a third portion 226 of the second labyrinth seal 220 to the annular space 234, from which the gas is received by the drain with the second fluid. Advantageously, the gas flowing through the first and second interfaces 166, 168 prevents the flow of the fluids therethrough, thus providing a seal between the sides 106, 108 of the seal assembly 100.

Thus, the inter-fluid brush seal assembly 100 of the present invention can substantially prevent the flow of fluids therethrough. Advantageously, one or more of the interfaces can be defined by brush seals. The brush seals can be relatively small relative to the axial length of labyrinth seals. Additionally, the gas required for forming a seal at the interfaces, in some cases, can be less than the gas that would be required to form a seal using labyrinth seals, thereby reducing the amount of gas for operating the seal assembly.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An inter-fluid brush seal assembly for substantially preventing the flow of at least one fluid adjacent a rotatable member, the seal assembly comprising:

a dispersion ring defining a bore extending therethrough for receiving the rotatable member, the dispersion ring defining a gas passage extending at least partially circumferentially around the bore of the dispersion ring and having first and second sides directed in opposite axial directions of the rotatable member;

at least one brush seal having a circumferential member and a plurality of elongate members, the circumferential member structured to extend circumferentially around the rotatable member and the elongate members being connected to the circumferential member and structured to extend generally radially inward to define a first flow restricting interface with the rotatable member, the at least one brush seal being directed toward the first side of the gas passage;

a second seal structured to extend circumferentially around the rotatable member, the second seal being positioned opposite the gas passage from the brush seal and directed toward the second side of the gas passage, the second seal defining a second flow restricting interface with the rotatable member;

a housing defining a bore for receiving the dispersion ring, the housing defining an inlet and first and second drains fluidly connected to the bore, the inlet being disposed axially between the first and second drains and fluidly connected to the gas passage, the first drain being fluidly connected to the first interface, and the second drain being fluidly connected to the second interface such that the first and second drains are configured to receive the gas from the inlet via the first and second interfaces, respectively;

at least one seal member structured to be received in the bore of the housing axially opposite a respective one of the drains from the gas passage, the seal member and a respective one of the interfaces defining an annular space therebetween in fluid communication with the respective drain, the seal member corresponding to the rotatable member such that the seal member partially restricts the flow of the fluid along the rotatable member and toward the respective drain; and a spacer disposed between the seal member and the respective interface such that the spacer maintains the annular space between the seal member and the respective interface and the annular space is fluidly connected to the respective drain, wherein the dispersion ring is configured to receive a gas from the inlet of the housing, communicate the gas through the gas passage, and deliver the gas to the first and second interfaces such that the gas substantially prevents the flow of fluid through the seal assembly.

2. A seal assembly according to claim 1 further comprising at least two brush seals defining the first interface.

3. A seal assembly according to claim 1 wherein the second seal comprises at least one brush seal having a circumferential member and a plurality of elongate members, the circumferential member structured to extend circumferentially around the rotatable member and the elongate members being connected to the circumferential member and structured to extend generally radially inward to define the second interface with the rotatable member.

4. A seal assembly according to claim 1 wherein the dispersion ring has inner and outer surfaces, the inner surface being directed toward the rotatable member, the dispersion ring defining first and second walls extending radially inward from the inner surface toward the rotatable member and defining the gas passage therebetween, and the dispersion ring defining at least one aperture extending radially between the outer surface and the inner surface at the gas passage.

5. A seal assembly according to claim 1 wherein the dispersion ring is configured to deliver the gas to the first interface at a substantially uniform pressure.

6. A seal assembly according to claim 1 wherein the dispersion ring is configured to receive the at least one brush seal therein.

7. A seal assembly according to claim 1 wherein the inlet and the first and second drains each define an annular space extending circumferentially around the bore of the housing, such that fluid can be communicated between each annular space and the respective one of the inlet and first and second drains.

8. A seal assembly according to claim 1 wherein the at least one brush seal and the dispersion ring are structured to be engaged to prevent relative rotation therebetween.

9. A seal assembly according to claim 1 further comprising a retaining ring structured to be received in the bore of the housing, the retaining ring defining a bore corresponding to the rotatable member such that the retaining ring partially restricts the flow of the fluid along the rotatable member.

10. A seal assembly according to claim 9 wherein the retaining ring defines a labyrinth seal.

11. A seal assembly according to claim 1 wherein the at least one seal member is a brush seal.

12. A seal assembly according to claim 1 wherein the housing defines an outer drain fluidly connected to a point along the rotatable member axially opposite at least a portion of the seal member from the gas passage.

13. A seal assembly according to claim 1 wherein the dispersion ring is configured to receive the seal member, the spacer and the dispersion ring each defining a plurality of apertures extending radially therethrough such that the annular space is fluidly connected to the respective drain.

14. A seal assembly according to claim 1 further comprising a gas source fluidly connected to the gas passage via the gas inlet and configured to supply a pressurized gas thereto.

15. A seal assembly according to claim 14 further comprising a control valve fluidly disposed between the gas source and the gas passage and configured to control the flow of gas to the gas passage.

16. A seal assembly according to claim 1 wherein the elongate members of the at least one brush seal are wire members extending generally radially inward from the circumferential member.

17. A method for substantially preventing the flow of at least one fluid through a seal assembly, the method comprising:

supplying a gas to a gas passage defined by a dispersion ring extending circumferentially around a rotatable member;

circulating the gas in a first axial direction and through a first interface defined by at least one brush seal and the rotatable member; and circulating the gas in a second axial direction opposite the first axial direction and through a second interface defined by a second seal and the rotatable member, wherein at least one of said circulating steps comprises circulating the gas through a respective one of the interfaces to an annular space defined by a spacer disposed between the respective interface and a seal member opposite the respective interface from the gas passage such that the gas flows from the annular space to a respective one of drains located axially opposite each side of the first and second interfaces from the gas passage and the circulation of the gas through the interfaces substantially prevents the flow of fluid therethrough.

18. A method according to claim 17 wherein said second circulating step comprises circulating the gas in the second direction and through a brush seal defining the second interface.

19. method according to claim 17 wherein said circulating steps comprise delivering the gas to the interfaces at a substantially uniform pressure.

20. A method according to claim 17 wherein said supplying step comprises supplying the gas through an inlet defined by a housing, the housing defining a bore structured to receive the rotatable member and the dispersion ring, such that the gas flows through the inlet and into the gas passage of the dispersion ring.

21. A method according to claim 20 further comprising supplying the gas circumferentially around the dispersion ring through an annular space defined by the housing.

22. A method according to claim 17 further comprising providing the at least one brush seal, the brush seal having a circumferential member and a plurality of elongate members, the circumferential member structured to extend circumferentially around the rotatable member and the elongate members being connected to the circumferential member and structured to extend generally radially inward to define the first interface with the rotatable member, the first interface thereby restricting flow of the fluid therethrough.

23. A method according to claim 17 further comprising providing a first fluid to the first interface opposite the gas passage and providing a second fluid to the second interface opposite the gas passage.

24. A method according to claim 17 further comprising draining the fluids and the gas through the drains axially opposite each side of the first and second interfaces from the gas passage.

25. A method according to claim 24 further comprising draining one of the fluids through an outer drain fluidly connected to a point along the rotatable member axially opposite at least a portion of the seal member from the gas passage.

26. A method according to claim 17 wherein said supplying step comprises adjusting a valve to control the flow of the gas from a gas source to the gas passage.

27. An inter-fluid brush seal assembly for substantially preventing the flow of at least one fluid adjacent a rotatable member, the seal assembly comprising:

a dispersion ring defining a bore extending therethrough for receiving the rotatable member, the dispersion ring defining a gas passage extending at least partially circumferentially around the bore of the dispersion ring and having first and second sides directed in opposite axial directions of the rotatable member;

at least one brush seal having a circumferential member and a plurality of elongate members, the circumferential member structured to extend circumferentially around the rotatable member and the elongate members being connected to the circumferential member and structured to extend generally radially inward to define a first flow restricting interface with the rotatable member, the at least one brush seal being directed toward the first side of the gas passage;

a second seal structured to extend circumferentially around the rotatable member, the second seal being positioned opposite the gas passage from the brush seal and directed toward the second side of the gas passage, the second seal defining a second flow restricting interface with the rotatable member;

a housing defining a bore for receiving the dispersion ring, the housing defining an inlet and first and second drains fluidly connected to the bore, the inlet being disposed axially between the first and second drains and fluidly connected to the gas passage, the first drain being fluidly connected to the first interface, and the second drain being fluidly connected to the second interface such that the first and second drains are configured to receive the gas from the inlet via the first and second interfaces, respectively; and a retaining ring disposed in the bore of the housing axially opposite the brush seal from the gas passage, the retaining ring defining a first labyrinth seal portion directed toward the brush seal, a second labyrinth seal portion opposite the first labyrinth seal portion from the brush seal, and an annular space between the first and second labyrinth seal portions in fluid communication with the first drain, each labyrinth seal portion corresponding to the rotatable member such that the retaining ring partially restricts the flow of the fluid along the rotatable member, wherein the dispersion ring is configured to receive a gas from the inlet of the housing, communicate the gas through the gas passage, and deliver the gas to the first and second interfaces such that the gas substantially prevents the flow of fluid through the seal assembly, and a flow of the gas through the first labyrinth seal portion of the retaining ring substantially prevents contact of the fluid with the brush seal.

* * * * *